US008780520B2

(12) United States Patent
Depping et al.

(10) Patent No.: US 8,780,520 B2
(45) Date of Patent: Jul. 15, 2014

(54) SURGE PROTECTION ELEMENT

(75) Inventors: Christian Depping, Lemgo (DE); Ralf Lange, Horn-Bad Meinberg (DE); Viktor Horvat, Blomberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 130 days.

(21) Appl. No.: 13/583,412

(22) PCT Filed: Mar. 9, 2011

(86) PCT No.: PCT/EP2011/001145

§ 371 (c)(1), (2), (4) Date: Sep. 7, 2012

(87) PCT Pub. No.: WO2011/110330

PCT Pub. Date: Sep. 15, 2011

(65) Prior Publication Data

US 2013/0003243 A1 Jan. 3, 2013

(30) Foreign Application Priority Data

Mar. 10, 2010 (DE) ..... 10 2010 010 980

(51) Int. Cl.
*H01H 71/20* (2006.01)
*H01H 1/00* (2006.01)

(52) U.S. Cl.
USPC ..... 361/124; 361/127; 337/219

(58) Field of Classification Search
USPC ..... 361/124, 127; 337/219
See application file for complete search history.

(56) References Cited

U.S. PATENT DOCUMENTS

| | | | | | |
|---|---|---|---|---|---|
| 4,801,772 | A | * | 1/1989 | Bratkowski et al. | 218/117 |
| 5,311,164 | A | * | 5/1994 | Ikeda et al. | 337/28 |
| 5,311,393 | A | * | 5/1994 | Bird | 361/104 |
| 5,831,507 | A | * | 11/1998 | Kasamatsu et al. | 337/4 |
| 5,986,870 | A | * | 11/1999 | Kapp | 361/127 |
| 5,999,391 | A | * | 12/1999 | Lou et al. | 361/103 |

(Continued)

FOREIGN PATENT DOCUMENTS

| | | | |
|---|---|---|---|
| DE | 3131630 | A1 | 2/1983 |
| EP | 0987803 | A1 | 3/2000 |
| WO | WO 2005112050 | A1 | 11/2005 |

OTHER PUBLICATIONS

European Patent Office, International Search Report in International Patent Application No. PCT/EP2011/001145 (May 18, 2011).

*Primary Examiner* — Scott Bauer
(74) *Attorney, Agent, or Firm* — Leydig, Voit & Mayer, Ltd.

(57) ABSTRACT

A surge protection element includes a contact stud and a contact element disposed at a distance from the contact stud. A connection element is configured to be transferred into a first position, in which the connection element is applied to the contact stud and to the contact element so as to electrically connect the contact stud to the contact element, and into a second position, in which the connection element is disposed at a distance from the contact stud and the contact element. In the first position, the connection element engages at least partially around at least one of the contact stud and the contact element and a thermally separable connection is provided between the connection element and the contact stud and between the connection element and the contact element.

14 Claims, 8 Drawing Sheets

(56) References Cited

U.S. PATENT DOCUMENTS

| | | | | |
|---|---|---|---|---|
| 6,430,019 | B1 * | 8/2002 | Martenson et al. | 361/124 |
| 7,656,640 | B2 * | 2/2010 | Domejean et al. | 361/131 |
| 7,864,024 | B2 * | 1/2011 | Schlenker et al. | 337/407 |
| 8,013,712 | B2 * | 9/2011 | Cernicka | 338/198 |
| 2006/0145807 | A1 | 7/2006 | Gautier | |
| 2006/0245125 | A1 * | 11/2006 | Aszmus | 361/56 |
| 2008/0043395 | A1 * | 2/2008 | Donati et al. | 361/118 |
| 2009/0316319 | A1 * | 12/2009 | Depping et al. | 361/91.1 |

* cited by examiner

SURGE PROTECTION ELEMENT

CROSS-REFERENCE TO PRIOR APPLICATIONS

This application is a U.S. National Phase application under 35 U.S.C. §371 of International Application No. PCT/EP2011/001145, filed on Mar. 9, 2011, and claims benefit to German Patent Application No. DE 10 2010 010 980.0, filed on Mar. 10, 2010. The International Application was published in German on Sep. 15, 2011 as WO 2011/110330 under PCT Article 21(2).

FIELD

The invention relates to a surge protection element.

BACKGROUND

Surge protection elements are often used to protect electric and electronic apparatuses against surges which may be transmitted via the electric mains. In particular, surges of this type can be produced from lightning discharges which, for example, couple into the infrastructure of the mains via an earthing system.

Such a surge protection element is known for example from EP 0 987 803 B1 in the form of a device for protecting against surges in electric apparatuses to which the device is connected via connection means comprising at least two connectors, the device also having a lightning protection cell, the first pole of which is directly connected to a first connector. A second pole of the cell is connected to a first conductor portion. The device further comprises a second conductor portion, which is directly connected to a second connector. In addition, the device has safety fuses to keep a stable slider in electrical contact with the conductor portions in an operating position of the device, the means being used to permanently push the slider into an open position of the device, in which position the slider is no longer in contact with the two conductor portions.

However, a surge protection element of this type is only suitable for relatively low-energy pulse loading and for low dynamic current forces resulting therefrom. In this case, dynamic current forces are determined mostly by the pulse form and in part also by the magnitude of the amplitude in the surge current.

SUMMARY

In an embodiment, the present invention provides a surge protection element including a contact stud and a contact element disposed at a distance from the contact stud. A connection element is configured to be transferred into a first position, in which the connection element is applied to the contact stud and to the contact element so as to electrically connect the contact stud to the contact element, and into a second position, in which the connection element is disposed at a distance from the contact stud and the contact element. In the first position, the connection element engages at least partially around at least one of the contact stud and the contact element and a thermally separable connection is provided between the connection element and the contact stud and between the connection element and the contact element.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
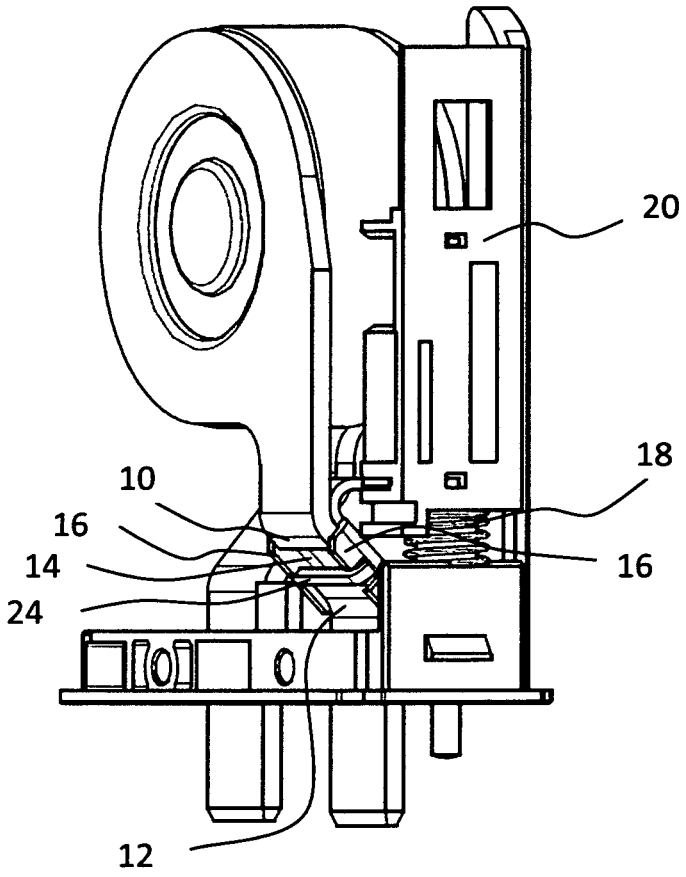
FIG. 1 is a schematic representation of a surge protection element according to a first embodiment, in a contacting state.

In an embodiment, the invention provides a surge protection element by means of which surge currents of high amplitude (typically 8/20 μs-pulse), such as might occur in the event of switching operations, and high-energy partial lightning currents (typically 10/350 μs-pulse) can both be reliably arrested.

The surge protection element according to an embodiment of the invention comprises a contact stud and a contact element which is arranged at a distance from the contact stud, wherein a connection element is provided which can be transferred into a first position and into a second position, wherein, in the first position, the connection element is applied to the contact stud and to the contact element for electrically connecting the contact stud to the contact element and, in the second position, the connection element is arranged at a distance from the contact stud and the contact element, wherein, in the first position, a thermally separable connection is provided between the connection element and the contact stud and between the connection element and the contact element, wherein, in the first position, the connection element engages around the contact stud and/or the contact element at least in part.

The connection element is used for the purpose of making it possible to produce contacting between the contact stud and the contact element arranged at a distance from the contact stud, wherein in the contacting state, in the first position of the connection element, the connection element being applied to a surface of the contact stud and to a surface of the contact element, the connection element being adapted at least in part to the contour of the contact stud and the contour of the contact element. The surface of the contact stud and the surface of the contact element, to which the connection element is applied, can be in a plane with respect to one another in this arrangement, such that the connection element acts as a type of bridge and overlaps the surface of the contact stud and the surface of the contact element, or the surfaces can be mutually opposed such that the connection element is arranged between the contact stud and the contact element. A thermally separable connection is provided on each of the surfaces of the connection element which are contiguous with the contact stud and on each of the surfaces of the connection element which are contiguous with the contact element, which thermally separable connection is for example in the form of a soldering flux and serves to connect the connection element to the contact stud and the connection element to the contact element. The thermally separable connection is in this case preferably applied extensively between the connection element and the contact stud and between the connection element and the contact element. In this case, a higher current amplitude can be carried via an extensive contact owing to the larger cross section. In addition, a large contact surface provides greater stability of the connection.

If, in the event of the surge protection element becoming overloaded, the thermally separable connection reaches a temperature equating to the melting temperature, the thermally separable connection then melts, and the connection element is therefore released and moves from the first position into a second position in which the connection element is arranged at a distance from the contact stud and the contact element. Movement of the connection element is preferably achieved in that the connection element is connected to a biased spring element which is activated on melting of the thermally separable connection and moves the connection element away from the contact stud and the contact element.

The surge protection element according to an embodiment of the invention is distinctive in that, in the first position, the connection element engages at least in part around the contact stud and/or the contact element. As a result, it is possible to achieve particularly high mechanical stability of the connection between the connection element and the contact stud and/or between the connection element and contact element, in the first position, and it is therefore possible to arrest, by means of the surge protection element, surge currents having dynamic high-energy pulse forms, as is possible using surge protection elements known from the prior art. In this case, the connection element can for example have a U-shaped configuration, such that the connection element engages at least in part around one or more edge regions of the contact stud and/or of the contact element.

According to a preferred embodiment of the invention, a clearing element is provided which is movably arranged between the contact stud and the contact element arranged at a distance from the contact stud. In the event of separation of the contacting between the contact element and contact stud on the occurrence of overloading of the surge protection element, the clearing element is used for the purpose of removing the residue of the thermally separable connection remaining in the gap between the contact element and the contact stud in order to ensure that an electric connection is no longer possible between the contact stud and the contact element. For this purpose, when the connection element moves from the first position into the second position, the clearing element is preferably displaced or moved within the gap between the contact stud and the contact element in order to clear the gap, preferably of the thermally separable connection. The clearing element is preferably moved within the gap from the contact element towards the contact stud in order to achieve as complete as possible clearing of the residue of the thermally separable connection in the gap. The clearing element can for example be formed as a clearing finger or a clearing plate. Where the clearing element is formed as a clearing finger, the clearing element is then moved within the gap when the contacting separates owing to the connection element being conveyed from the first position into the second position, wherein on reaching the second position, the clearing element is moved out of the gap between the contact stud and the contact element. Where the clearing element is formed as a clearing plate, the clearing element then preferably remains, in the second position of the connection element, within the gap between the contact element and the contact stud and thus acts as a shield in order to be able to interrupt any arcs that may arise on separation of the contacting.

The clearing element is preferably arranged on the connection element and can, in this case, be integrally connected to the connection element or, alternatively, can be arranged on and fixed to the connection element as a separate component. Where the clearing element is arranged on the connection element, the clearing element preferably performs the same movement as the connection element, meaning that it is not necessary to provide a separate movement mechanism for the clearing element since it can for example also be moved by means of the spring element which is connected to the connection element.

In the alternative, it is preferably provided for the clearing element to be moved independently of the connection element. In this configuration, the clearing element can for example be moved into the gap between the contact stud and the contact element after the connection element has been moved from the first position into the second position. In this manner, decoupling of the movement processes of the connection element and of the clearing element is possible. In order to achieve movement of the clearing element, a second spring element or lever, for example, can be provided and connected to the clearing element.

Furthermore, it is preferably provided for the clearing element to be formed from an insulating material. Preferably, the clearing element is formed from a plastics material. By means of forming the clearing element from an insulating material, any arcs that may arise on separation of the contacting between the contact stud and the contact element in the event of overloading can be interrupted.

According to a further advantageous embodiment of the invention, the connection element has a trough-shaped configuration. The connection element preferably has a trough-shaped configuration where the contact element and the contact stud are arranged mutually in parallel and the surface of the contact stud and the surface of the contact element, on which the connection element is contacted, are mutually opposed, such that the connection element is arranged at least in regions between the contact stud and the contact element. Where the connection element has a trough-shaped configuration, it can clear the thermally separable connection out of the gap between the contact stud and the contact element itself as it travels from the first position into the second position, and no additional clearing element would be necessary for this purpose. A thus-formed connection element can thereby fulfill two functions at the same time in that it, first, when in the first position, produces an electric contacting between the contact element and the contact stud and, second, acts as a clearing element for cleaning out the gap between the contact element and the contact stud in the event of separation of the electric contacting and as the connection element moves from the first position into the second position.

The thermally separable connection is preferably formed from a material which can be transformed into a semi-liquid state when a melting temperature is exceeded. A situation in which the thermally separable material drips uncontrollably as it melts during separation of the contacting can thereby be avoided. The thermally separable material is preferably formed from a non-eutectic material, meaning that the material of the thermally separable connection first goes through a viscous or paste-like phase as it melts.

Figure 2:
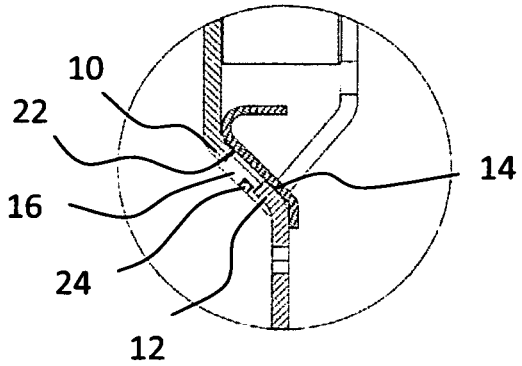
FIG. 2 is a schematic cross section of a detail of the surge protection element shown in FIG. 1.
Figure 3:
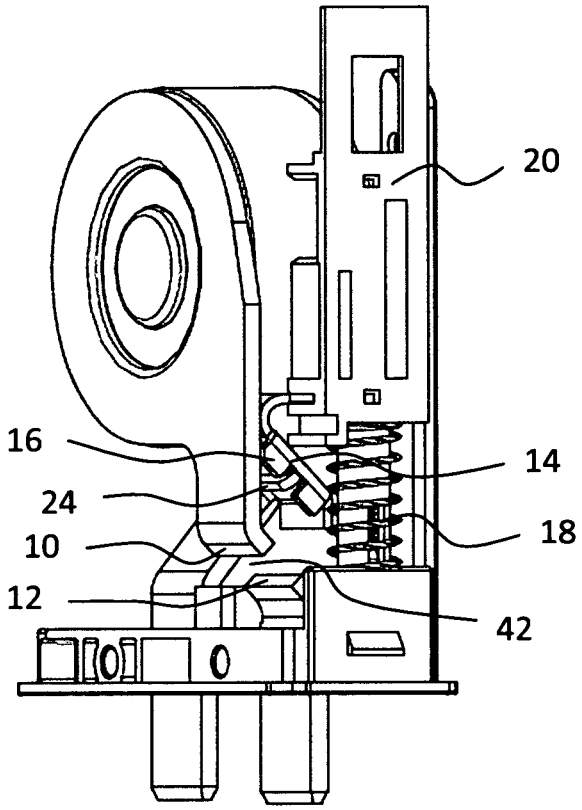
FIG. 3 is a schematic representation of the surge protection element according to the first embodiment, in a non-contacting state.
Figure 4:
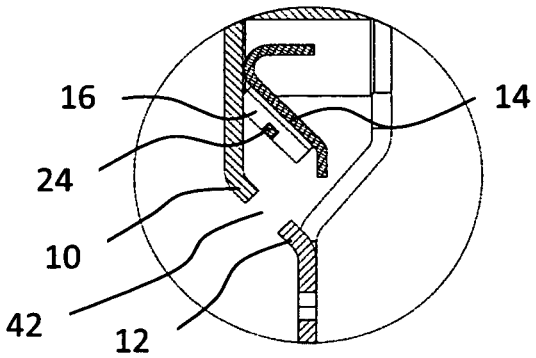
FIG. 4 is a schematic cross section of a detail of the surge protection element shown in FIG. 3.
Figure 5:
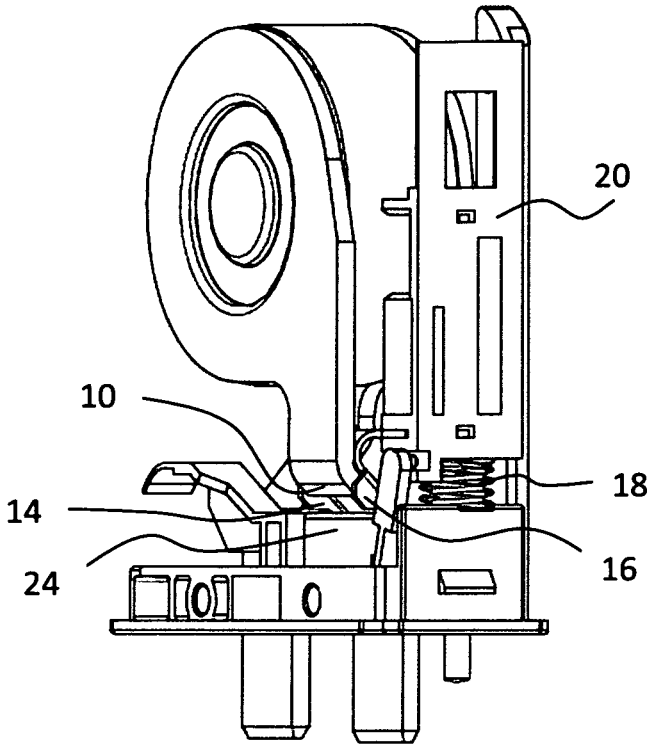
FIG. 5 is a schematic representation of a surge protection element according to a second embodiment, in a contacting state.
Figure 6:
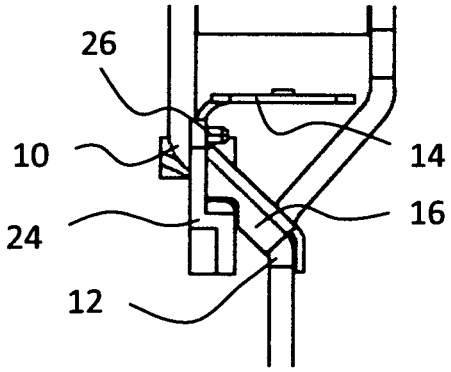
FIG. 6 is a schematic cross section of a detail of the surge protection element shown in FIG. 5.

FIG. 1-4 show a surge protection element according to a first embodiment. The surge protection element is conventionally arranged in a housing and comprises a contact stud 10 and a contact element 12 arranged at a distance to the contact stud 10. In order to produce electrical contacting between the contact stud 10 and the contact element 12, a connection element 14 is provided which, when in a contacting state as shown, for example, in FIG. 1 and FIG. 2, is applied to the contact element 12 and the contact stud 10. In this case, the connection element 14 is in the first position in which one of its lateral surfaces 22 is applied to a surface of the contact stud 10 and to a surface, arranged in a plane with respect to the surface of the contact stud 10, of the contact element 12. In the first position, the contact stud 10 and the contact element 12 are thus applied to the same lateral surface 22 of the connection element 14. In this manner, the contact surface plays a significant role in determining the maximum amplitude of the surge currents that can be arrested. A thermally separable connection is provided between the lateral surface 22 of the connection element 14 and the surface, facing towards the lateral surface 22, of the contact stud 22 and the surface, facing towards the lateral surface 22, of the contact element 12, which thermally separable connection is preferably in the form of a soldering flux, fixes the connection element 14 in the first position to the contact element 12 and the contact stud 10, and melts in the event of overloading of the surge protection element on reaching of a temperature equating to the melting temperature of the material of the thermally separable connection, such that the fixing is released and the connection element 14 is able to be moved away from the contact stud 10 and the contact element 12 towards the second position, as can be seen in FIG. 3 and FIG. 4. The connection element 14 is moved by means of a biased spring element 18 which is connected to the connection element 14 via a movable slide 20.

In this embodiment, the connection element 14 is formed in such a way that it surrounds the edge regions of the contact element 12 and of the contact stud 10 by way of the connection element 14 being provided with angled lateral parts 16. In this manner, particularly high mechanical stability can be achieved in the contacting state in the connection between the connection element 14 and the contact stud 10 and the contact element 12, whereby the surge protection element can be used for particularly high-energy surge currents.

A clearing element 24 in the form of a clearing finger is arranged on the lateral surface 22 of the connection element 14, by means of which clearing element the gap 42 between the contact stud 10 and the contact element 12 can be ridden of the residue of the thermally separable connection after separation of the contacting between the contact stud 10 and the contact element 12. In the first position, in the contacting state, the clearing element 24 is arranged in the gap 42 between the contact stud 10 and the contact element 12, as can be seen in FIG. 1 and FIG. 2. When the connection element 14 moves from the first position to the second position, shown in FIG. 3 and FIG. 4, the clearing element 24 is moved within the gap 24, starting from the contact element 12 and moving towards the contact stud 10, and is subsequently removed from or moved out of the gap 42.

Figure 7:
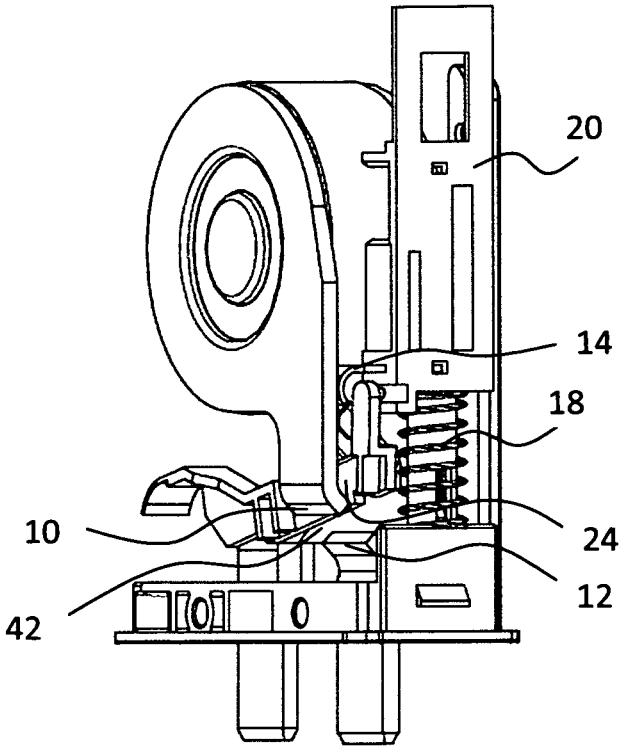
FIG. 7 is a schematic representation of the surge protection element according to the second embodiment, in a non-contacting state.
Figure 8:
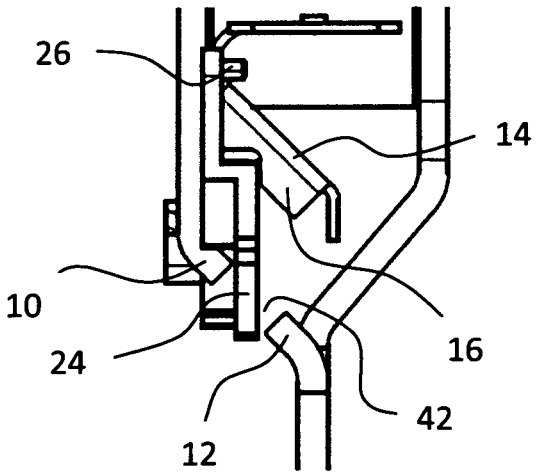
FIG. 8 is a schematic cross section of a detail of the surge protection element shown in FIG. 7.

FIG. 5-8 show a second possible embodiment of the surge protection element according to the invention. The surge protection element shown here basically corresponds to the surge protection element shown in FIG. 1-4, the clearing element 24 in this case being formed as a clearing plate which remains in the gap 42 between the contact stud 10 and the contact element 12 also in the second position of the connection element 14, as shown in FIG. 7 and FIG. 8, the clearing element 24 thus acting as a protection element in order to prevent arcs from occurring as the contact stud 10 and the contact element 12 separate. In this second embodiment shown here, the clearing element 24 is arranged, as a separate component, on the connection element 14 via a hinge element 26.

Figure 9:
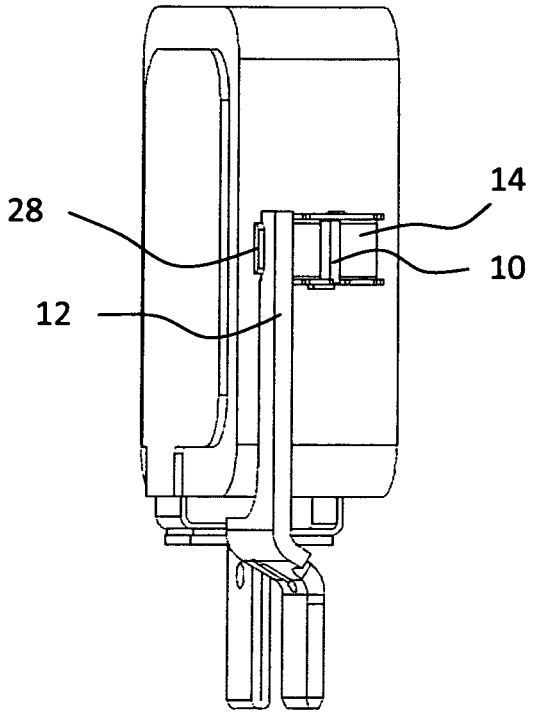
FIG. 9 is a schematic representation of a surge protection element according to a third embodiment, in a contacting state.
Figure 10:
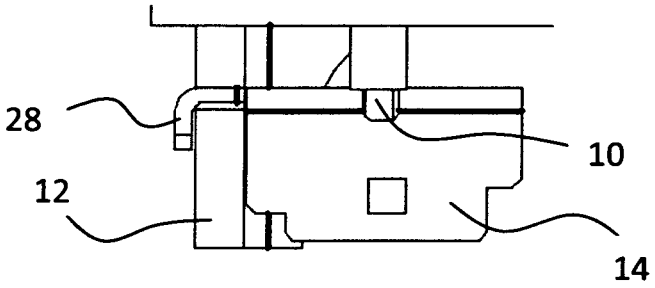
FIG. 10 is a schematic plan view of the surge protection element shown in FIG. 9.
Figure 11:
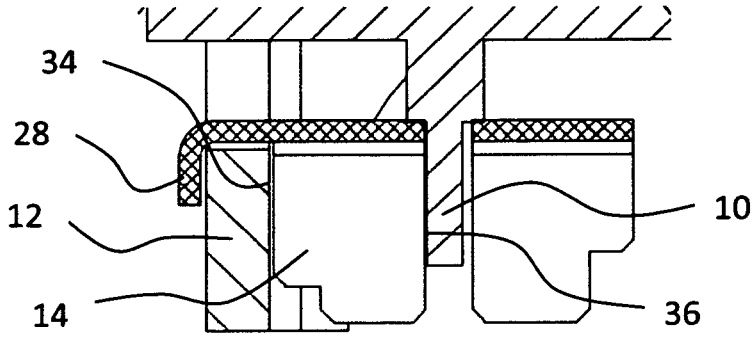
FIG. 11 is a cross section of the representation shown in FIG. 10 of the surge protection element according to the third embodiment.

FIG. 9-12 show a third possible embodiment of the surge protection element according to the invention, in which embodiment the contact stud 10 and the contact element 12 are arranged so as to be mutually opposed and mutually in parallel, such that, in the first position, at least a portion of the connection element 14 is arranged between the contact stud 10 and the contact element 12, the connection element 14 engaging around the contact stud 10 in a U-shaped configuration, as can be seen in FIG. 10 and FIG. 11, and additionally engaging in part around the contact element 12 via an angled wall 28. A thermally separable connection is provided on each of the interfaces 34, 36, as shown in FIG. 11, between the connection element 14 and the contact stud 10 and between the connection element and the contact element 12.

Figure 12:
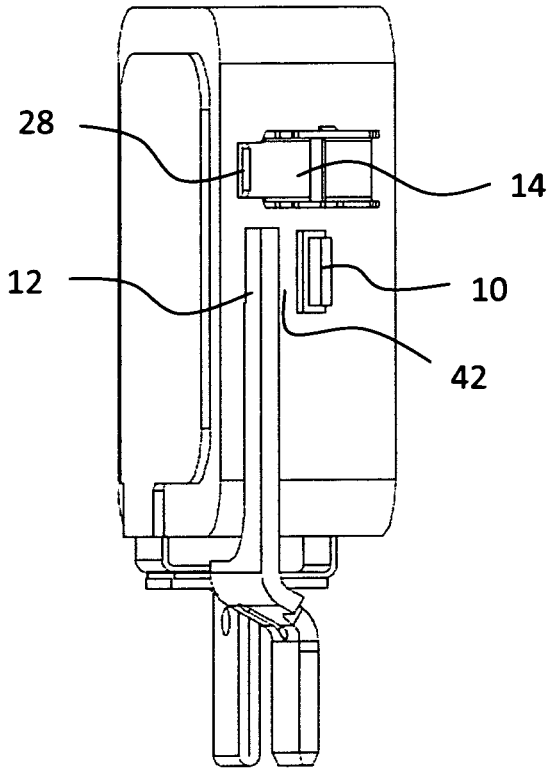
FIG. 12 is a schematic representation of the surge protection element according to the third embodiment, in a non-contacting state.

The connection 14 element has a trough-shaped configuration in this case, meaning that the connection element 14 can itself clear the thermally separable connection out of the gap 42, as can be seen in FIG. 12, between the contact stud 10 and the contact element 12 as it travels from the first position, shown in FIG. 9-11, into the second position, shown in FIG. 12, and no additional clearing element would be necessary for this purpose. In the second position, the connection element 14 is entirely remote from the gap 42 between the contact stud 10 and the contact element 12.

In this case, the connection element 14 is preferably also connected to a biased spring element in order to achieve movement of the connection element 14 from the first position into the second position.

In particular in this embodiment, the thermally separable connection is preferably formed from a material which can be transformed into a semi-liquid state when a melting temperature is reached. A situation in which the thermally separable connection drips uncontrollably as it melts is thus avoided. The thermally separable connection is preferably formed from a non-eutectic material, meaning that the material of the thermally separable connection first goes through a viscous or paste-like phase as it melts.

Figure 13:
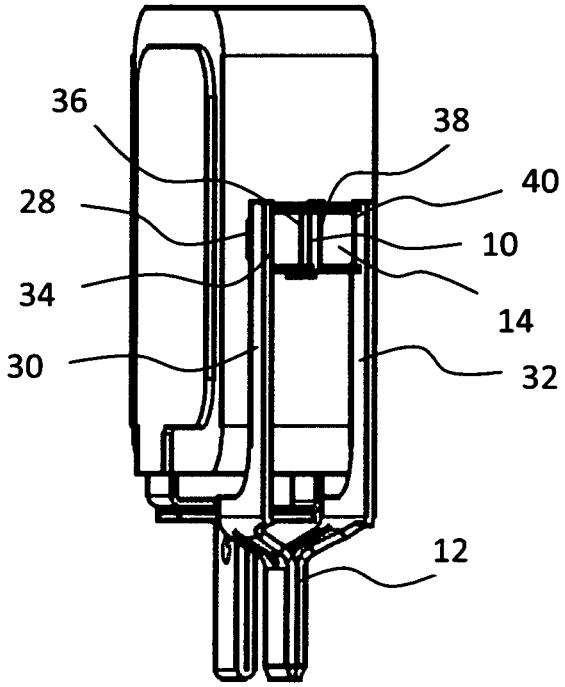
FIG. 13 is a schematic representation of a surge protection element according to a fourth embodiment, in a contacting state.
Figure 14:
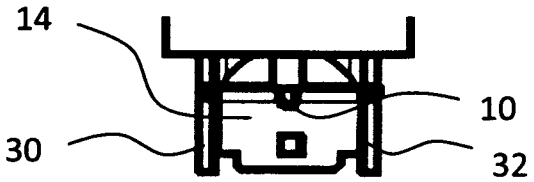
FIG. 14 is a schematic plan view of the surge protection element shown in FIG. 13.
Figure 15:
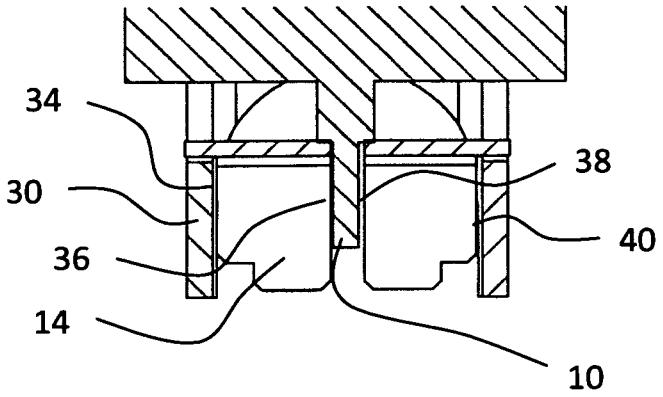
FIG. 15 is a cross section of the representation shown in FIG. 14 of the surge protection element according to the fourth embodiment.
Figure 16:
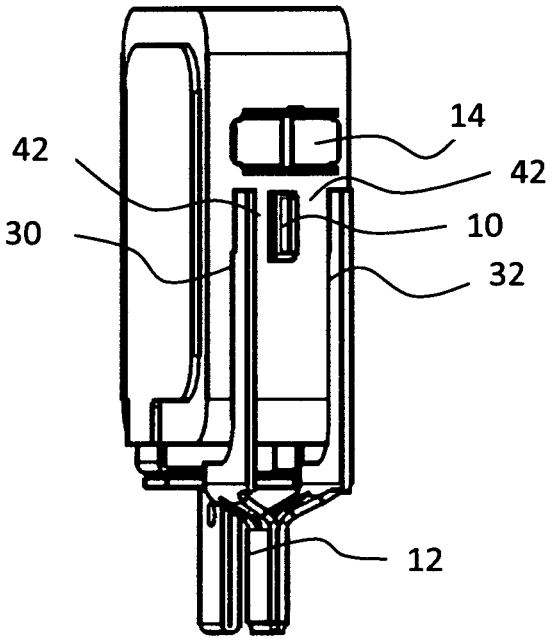
FIG. 16 is a schematic representation of the surge protection element according to the fourth embodiment, in a non-contacting state.

FIG. 13-16 show a fourth possible embodiment of the surge protection element according to the invention, in which embodiment the surge protection element shown here basically corresponds to the surge protection element shown in FIG. 9-12, the contact element 12 of the fourth embodiment shown here comprising a first contact arm 30 and a second contact arm 32 which is guided parallel thereto. The trough-shaped connection element 14 can in this case be arranged, when in the first position, between the first contact arm 30 and the second contact arm 32 of the contact element 12, as can be seen in FIG. 13-15, the connection element 14 engaging around the contact stud in a U-shaped configuration, which contact stud is arranged between the first contact arm 30 and the second contact arm 32. The thermally separable connection is basically arranged on four interfaces 34, 36, 38, 40 between the contact stud 10, the contact arms 30, 32 and the connection element 14, meaning that solely as a result of the increased number of interfaces 34, 36, 38, 40 on which a thermally separable connection is provided, higher mechanical stability can be achieved and higher-energy surge currents can thereby be arrested. In addition, the contact surface is enlarged and surge currents having higher amplitudes can therefore be arrested. This advantage is further reinforced by splitting the current on two arms 30, 32 arranged mutually in parallel.

By means of the surge protection element shown in FIG. 13-16, particularly high-energy surge currents can be carried. Where the contact arms 30, 32 which are arranged mutually in parallel carry current at the same time and in the same direction, then the contact arms 30, 32 are attracted to one another via the magnetic field which accompanies the current flow. As a result, where a surge current is flowing, lower mechanical loading acts on the thermally separable connections provided on the interfaces 34, 36, 38, 40, since the mutually attracted contacts arms 30, 32 push the connection element 14 onto the contact stud 10, such that mechanical support of the thermally separable connection can be achieved in the interfaces 34, 36, 38, 40 by this means, thus meaning that the interfaces 34, 36, 38, 40 themselves can have smaller dimensions or the amount of the thermally separable connection to be applied to the interfaces 34, 36, 38, 40 can be reduced.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

LIST OF REFERENCE NUMERALS

| | |
|---|---|
| Contact stud | 10 |
| Contact element | 12 |
| Connection element | 14 |
| Lateral part | 16 |
| Spring element | 18 |
| Slide | 20 |
| Lateral surface | 22 |
| Clearing element | 24 |
| Hinge element | 26 |
| Wall | 28 |
| First contact arm | 30 |
| Second contact arm | 32 |
| Interface | 34 |

-continued

| | |
|---|---|
| Interface | 36 |
| Interface | 38 |
| Interface | 40 |
| Gap | 42 |

The invention claimed is:

1. A surge protection element, comprising:

a contact stud;

a contact element disposed at a distance from the contact stud; and a connection element configured to be transferred into a first position in which the connection element is applied to the contact stud and to the contact element so as to electrically connect the contact stud to the contact element, and into a second position in which the connection element is disposed at a distance from the contact stud and the contact element, and wherein, in the first position, the connection element engages at least partially around at least one of the contact stud and the contact element and a thermally separable connection is provided between the connection element and the contact stud and between the connection element and the contact element.

2. The surge protection element according to claim 1, further comprising a clearing element movably disposed between the contact stud and the contact element.

3. The surge protection element according to claim 2, wherein the clearing element is disposed on the connection element.

4. The surge protection element according to claim 2, wherein the clearing element is moveable independently from the connection element.

5. The surge protection element according to claim 2, wherein the clearing element is formed from an insulating material.

6. The surge protection element according to claim 2, wherein, in the second position of the connection element, the clearing element remains in a gap between the contact stud and the contact element.

7. The surge protection element according to claim 2, wherein the connection element has a trough-shaped configuration.

8. The surge protection element according to claim 1, wherein the thermally separable connection is formed from a material that is transformable into a semi-liquid state when a melting temperature is reached.

9. The surge protection element according to claim 1, wherein the contact element includes a first contact arm and a second contact arm configured to be guided parallel to the first contact arm.

10. The surge protection element according to claim 9, wherein the contact stud is disposed between the first contact arm and the second contact arm of the contact element.

11. The surge protection element according to claim 9, wherein, in the first position, the connection element is disposed between the first contact arm and the second contact arm of the contact element.

12. The surge protection element according to claim 9, wherein the connection element engages around the contact stud in a U-shaped configuration.

13. The surge protection element according to claim 9, wherein, in the first position, the connection element forms at least one first contact surface with the first contact arm, at least one second contact surface with the second contact arm and at least a third contact surface and a fourth contact surface with the contact stud.

14. The surge protection element according to claim 13, wherein the thermally separable connection is disposed on at least each of the first, second, third and fourth contact surfaces.

* * * * *